United States Patent [19]

Kashio

[11] Patent Number: 4,945,331

[45] Date of Patent: Jul. 31, 1990

[54] ELECTROMAGNETIC ACTUATOR

[75] Inventor: Tadashi Kashio, Tokorozawa, Japan

[73] Assignee: Citizen Watch Co., Ltd., Tokyo, Japan

[21] Appl. No.: 385,001

[22] Filed: Jul. 25, 1989

[30] Foreign Application Priority Data

Jul. 29, 1988 [JP] Japan ..... 63-101520

[51] Int. Cl.[5] ..... H01F 7/08

[52] U.S. Cl. ..... 335/274; 335/276

[58] Field of Search ..... 335/269, 270, 271, 274, 335/275, 276, 277

[56] References Cited

U.S. PATENT DOCUMENTS 3,148,313 9/1964 Hancock ..... 335/271 X 3,389,354 6/1968 Ahlberg ..... 335/277 X

OTHER PUBLICATIONS

"Impact and Noise Abatement Apparatus for Electromagnetic Actuators,", IBM Technical Disclosure Bulletin, vol. 21, No. 2, Jul. 1978, p. 694.

"Slip-On Magnet Residual", IBM Technical Disclosure Bulletin, vol. 13, No. 8, Jan. 1971, p. 2234.

*Primary Examiner*—George Harris

*Attorney, Agent, or Firm*—Koda & Androlia

[57] ABSTRACT

An electromagnetic actuator for driving a hammer of an impact printer includes a solenoid and an armature which is attracted thereby. In a state of standby for printing, no current is supplied to the solenoid, and the armature holds the hammer in an urge-accumulated state. Upon supply of a current to the solenoid, the armature is attracted toward the core, and the hammer head in that state is released so as to be impacted against a platen, thereby effecting a printing operation. If the current is shut off with the armature attracted by the core of the solenoid, the armature returns to its original position. To effect a speedy return at that juncture, a return leaf spring having a resilient bent portion is interposed between the core and the armature.

7 Claims, 4 Drawing Sheets

ELECTROMAGNETIC ACTUATOR

BACKGROUND OF THE INVENTION

The present invention relates to an electromagnetic actuator for driving a hammer of an impact printer or the like, and more particularly to improvements of an electromagnetic actuator for obtaining releasibility of an armature attracted toward a core by the magnetic attractive force of a solenoid, at the time of the shutting off of a current supplied to the solenoid.

Conventionally, electromagnetic actuators, in which a solenoid having a coil of wire wound around a core is used as an electromagnet for generating a magnetic attractive force, are used in various industrial applications. Typical applications include, for instance, electric relays and electromagnetic clutches, in which the solenoid is used to attract a movable armature.

Printers that are output apparatus for computers or the like are another known field of application of the electromagnetic actuators.

A conventional impact printer is generally arranged such that hammers for respective columns are arranged in face-to-face relationship with a print drum along which recording paper is guided, and when the print drum is rotatively driven to predetermined printing positions, the hammers which are previously held at urge-accumulated positions by electromagnetic actuators against the force of printing springs are released and impacted against the print drum, thereby the hammer prints a desired type on the recording paper.

More specifically, the urge-accumulated state of the hammer is held by the armature of the electromagnetic actuator, and an exciting current is supplied to the electromagnetic actuator with the printing drum set at a predetermined printing position and at a predetermined timing set on the bases of a printing command, whereupon the armature releases the hammer so as to effect the above-described impacting operation.

FIG. 6 shows a cross-sectional view of a conventional electromagnetic actuator. As shown, a solenoid 10 comprises a coil 10*a*, a bobbin 10*b*, and a core 10*c*, the coil 10*a* being provided on the bobbin 10*b* and the core 10*c* being inserted in the bobbin 10*b*.

A spacer 13 is secured to an end surface of the core 10*c*. One end of a yoke 11 for introducing the magnetic flux of the solenoid 10 is secured to the solenoid 10.

An armature 12 is pivotally supported at the other end of the yoke 11 in such a manner as to be rotatable at a slit or indent (hereafter referred to as the slit) 11*a*. In addition, a return spring 15 is stretched in a state of tension between one end of a baseplate 14 to which the yoke 11 is secured and an end 12*a* of the armature 12. This return spring 15 holds the armature 12 in such a manner as to be rotatable with respect to the yoke 11 and urges the armature 12 in the direction of being released from the core 10*c*.

As a current is supplied to the coil 10*a* of the solenoid 10, the armature 12 is attracted toward the core 10*c* against the return force of the return spring 15, and is hence attracted to an end surface of the core 10*c* via a spacer 13.

This spacer 13 is formed of a nonmagnetic material and is adapted to prevent the armature 12 thus attracted from directly abutting against the core 10*c*. This arrangement is provided to prevent a delay in the release of the armature 12 caused by residual magnetism and weaken the attractive force so as to facilitate an immediate release thereof at the time of a shut-off of a current, thereby preventing faulty printing attributable to a delay in the release of the armature.

However, the conventional spacer merely forms a nonmagnetic gap between the armature and the core, so that it is difficult to positively obtain sufficient releasibility of the armature. Hence, it has been difficult to positively prevent faulty printing attributable to a delay in the release of the armature.

In other words, if the conventional spacer alone is used which is formed of a nonmagnetic material, the releasing of the armature cannot be effected speedily. If an attempt is made to increase the urging force of the armature returning spring so as to improve the releasibility of the armature, a problem is encountered in that the attractive force of the electromagnetic actuator must be increased.

Consequently, as described above, with impact printers or the like, since the releasing timing of the armature can be unstable, there are cases where erroneous printing or the like occurs, including double printing by the impacted hammer.

SUMMARY OF THE INVENTION

Accordingly, an object of the present invention is to provide an inexpensive, compact electromagnetic actuator which allows an armature to be released speedily from a core and which consumes less power and produces less heat, thereby overcoming the above-described drawbacks of the prior art.

To this end, in accordance with the present invention, there is provided an electromagnetic actuator comprising: a baseplate; a solenoid for producing a magnetic attractive force upon supply of an electric current thereto; a yoke disposed on the baseplate with the solenoid for introducing a magnetic flux produced by the solenoid; an armature having one end rotatably supported by the yoke and the other end attracted toward an end surface of a core of the solenoid; a return spring stretched in a state of tension between the baseplate and the end of the armature for urging the armature to be released from the solenoid; and a return leaf spring interposed between the core and the armature and formed of a nonmagnetic material, the return leaf spring having a portion bent in the direction of the thickness thereof, whereby the armature is deflected to store supplemental releasing force for the armature when the solenoid attracts the armature, and powerful releasibility is provided by the resiliency of the bent portion of the return leaf spring.

In other words, the electromagnetic actuator in accordance with the present invention is characterized in that a resilient return leaf spring formed of a nonmagnetic material is interposed between the core and the armature, and a bent portion is provided in the return leaf spring in such a manner as to be deflected with the armature attracted toward the core.

Accordingly, in accordance with the electromagnetic actuator in accordance with the present invention, when a current is supplied by an unillustrated drive circuit, a magnetic flux is produced by the solenoid, and the magnetic flux is introduced by the yoke so as to attract the armature.

This armature is provided in such a manner as to be attracted toward an end surface of the core of the solenoid via a nonmagnetic return leaf spring which has a resilient portion bent in the direction of its thickness.

Accordingly, when a magnetizing current is shut off with the armature being attracted by the core, instant releasibility is imparted to the armature by virtue of the resiliency of the bent portion. Hence, when the electromagnetic actuator in accordance with the present invention is applied to an impact printer, it is possible to positively effect an impacting operation and prevent a misprinting since the armature is released instantly from the core by virtue of the resiliency of the return leaf spring during a cut-off of the current.

DESCRIPTION OF THE PREFERRED EMBODIMENTS

Referring now to the accompanying drawings, a description will be given of an embodiment of the present invention.

Figure 1:
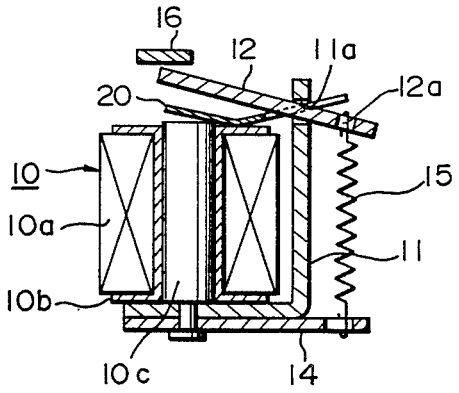
FIG. 1 is a side cross-sectional view of an electromagnetic actuator using a return leaf spring in accordance with an embodiment of the present invention.

FIG. 1 is a side cross-sectional view of an embodiment of an electromagnetic actuator in accordance with the present invention.

Figure 6:
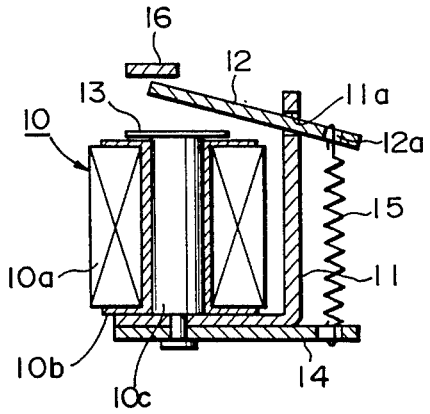
FIG. 6 PRIOR ART
FIG. 6 is a side cross-sectional view of a conventional electromagnetic actuator.

Since the arrangement of FIG. 1 is similar to that of the prior art shown in FIG. 6, identical parts will be denoted by the same reference numerals and a description thereof will b omitted.

In FIG. 1, the arrangement of this embodiment differs from that of the prior art in that the spacer 13 of the prior art is replaced by a return leaf spring 20. Hence, the other arrangements of the above-described prior art shown in FIG. 6 and its operation are identical with those of this embodiment.

This return leaf spring 20 which is formed of a nonmagnetic material such as phosphor bronze is bent at a longitudinally central portion thereof in the direction of the thickness thereof, and thus has a flat V-shaped configuration, as shown in FIG. 1.

Accordingly, the return leaf spring 20 in accordance with the present invention is characterized in that, unlike the conventional spacer 13 shown in FIG. 6, the return leaf spring 20 is not formed into the flat configuration of the spacer 13 which is merely secured to an end surface of the core, but adopts an arrangement in which its bent portion is provided with the resiliency of a spring.

This return leaf spring 20 is interposed between the above-described armature 12 and an end surface of a core 10*c*, one end thereof being retained at an indent (or slit) 11*a* of a yoke 11 in the same way as the one end of the above-described armature 12.

In other words, the armature 12 is rotatably supported at the slit 11*a* of the yoke 11, and one end of the return leaf spring 20 is similarly rotatably supported at the slit 11*a* of the yoke 11.

Figure 2:
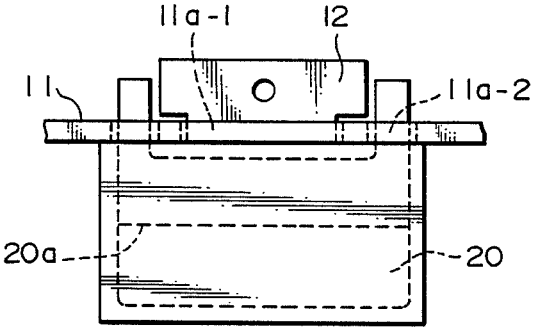
FIG. 2 is a top plan view of an armature and the return leaf spring, illustrating how they are supported.

FIG. 2 is a top plan view of a modification of this embodiment, illustrating how the armature 12 and the return leaf spring 20 are supported. As described above, ends of the armature 12 and the leaf spring 20 are retained at the slit 11*a* of the yoke 11. In this modification, however, the slit 11 is divided into a slit 11*a*-1 for the armature 12 and two slits 11*a*-2 for the leaf spring 20.

In the top plan view shown in FIG. 2, a bend of the leaf spring 20 is denoted by reference numeral 20*a*, and the leaf spring 20 has a flat V-shaped configuration which is upwardly open, as shown in FIG. 1. Incidentally, FIG. 1 shows an arrangement in which the slit 11*a* for the armature 12 and the leaf spring 20 is constituted by a single slit.

In this embodiment, when the solenoid 10 is not being excited, the armature 12 maintains a state in which it is not in contact with the leaf spring 20 and receives the urging force of the return spring 15 alone.

In addition, the armature 12 is brought into contact with the leaf spring 20 only at the last stage when the armature is attracted by the solenoid, whereupon the armature 12 deflects the leaf spring 20. Therefore, until the armature 12 is brought into contact with the leaf spring 20, it suffices for the attractive force of the solenoid 10 to be merely such as to capable of counteracting the urging force of the return spring 15.

The embodiment of the present invention is arranged as described above, and the operation thereof will be described hereinunder.

When a current is supplied to the coil 10*a* of the solenoid 10 and a magnetic attractive force is hence produced, the armature 12 is attracted toward an end surface of the core 10*c* of the solenoid 10 against the resiliency of a return spring 15.

When the electromagnetic actuator in accordance with the present invention is used as a means for driving the hammer of a printer, the hammer held in an urge-accumulated state is released toward a printing drum as the armature 12 rotates. In other words, when the armature 12 is attracted upon the supply of a current to the solenoid 10, a printing operation is effected.

In most of the range in which the armature 12 rotates counterclockwise, as viewed in FIG. 1, upon being attracted by the solenoid 10, the armature 12 is not brought into contact with the leaf spring 20. Consequently, it suffices for the attractive force of the solenoid 10 to be merely such as to be capable of overcoming the urging force of the return spring 15, and there is no need to supply a large driving current to the solenoid 10. Accordingly, even with respect to the initial state in which the armature 12 is separated from the core 10*c* and the armature 12 is difficult to attract, it is possible to effect the attracting operation of the armature 12 sufficiently with the attractive force shown by the characteristic 102 in FIG. 5 without any need to take the leaf spring 20 into consideration.

When the armature 12 is attracted in the final stage of its traveling, the return leaf spring 20 is deflected in the direction opposite to the bending direction by the pressing force of the armature 12 thus attracted. As a result, while a current is being supplied to the solenoid 10, the armature 12 continues to be attracted to the core 10*c* via the return leaf spring 20 and the return leaf spring 20 maintains its deflected state.

In this final stage, since the armature 12 has already moved to a position sufficiently close to the core 10*c*, the armature 12 can receive a sufficient force for deflecting the leaf spring 20.

Accordingly, in the present invention, it is unnecessary to supply a greater exciting current to the solenoid than a conventional one in order to obtain the deflecting force of the leaf spring 20.

In this state, the printing operation has already been completed, and in order to reduce the power consumption as much as possible, the power supply to the solenoid 10 is shut off speedily. In addition, in order to be prepared for an ensuing printing operation, it is preferred that the armature 12 speedily returns to its original position (see FIG. 1) by means of the return force of the return spring 15.

Accordingly, when the current supplied to the solenoid 10 is shut off by an unillustrated drive circuit, the magnetic attractive force is cut off, so that the armature 12 returns to its original position by means of the returning forces of the return spring 15 and the return leaf spring 20. In other words, the return leaf spring 20 operates in such a manner as to aid the returning operation of the armature 12 effected by the return spring 15.

Figure 3:
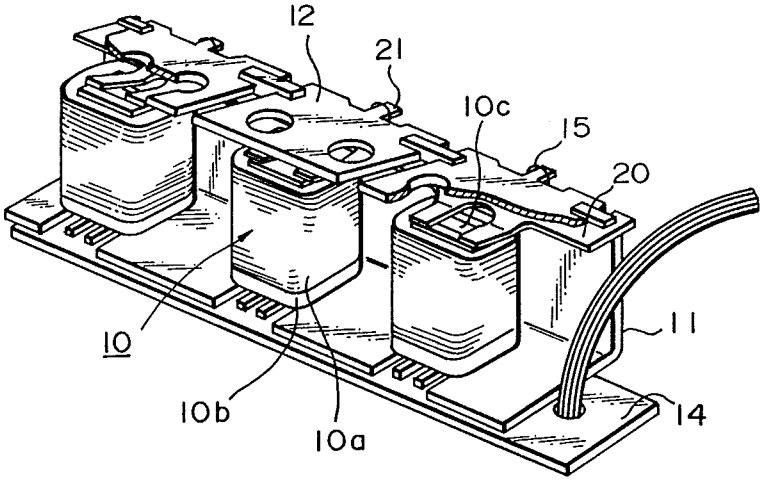
FIG. 3 is a perspective view of the electromagnetic actuator, with armatures partly cut away, in accordance with another embodiment of the present invention.

FIG. 3 is a perspective view of another embodiment of the present invention in which three electromagnetic actuators are formed integrally, parts of the armatures 12 being cut away for the sake of illustration.

The electromagnetic actuators such as those shown in the drawing are incorporated in the above-described impact printer or the like and are used primarily for effecting an impacting operation.

The characteristic feature of this embodiment lies in that a plurality of the return leaf springs 20 respectively interposed between the cores 10*c* and the armatures 12 are mounted in an integrated manner.

In other words, since the respective return leaf springs 20 of the three electromagnetic actuators are mounted on the yoke 11 not separately but integrally, there are advantages in that it is possible to simplify the structure of the return leaf springs 20, and that the manufacturing costs can be reduced without increasing the number of components used.

Figure 4:
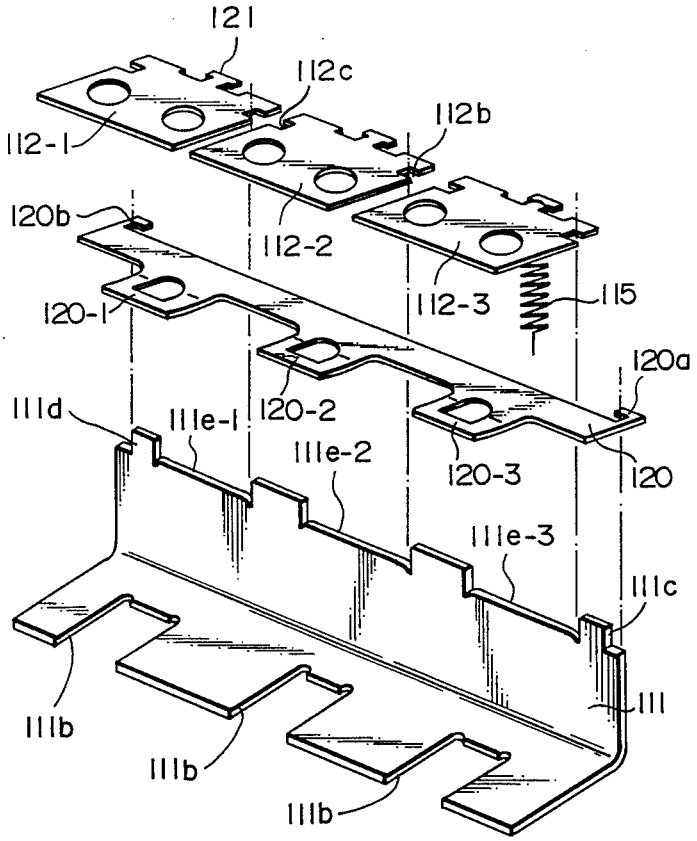
FIG. 4 is an exploded perspective view of an essential portion of the electromagnetic actuator in accordance with still another embodiment of the present invention.

FIG. 4 is an exploded perspective view of still another embodiment of the present invention which slightly differs from the above-described embodiment shown in FIG. 3. Specifically, three solenoids are mounted on a yoke 111, and, although not shown, bottoms of the solenoids are respectively fitted in three openings 111*b* provided in the yoke 111. In addition, three armatures 112-1, 112-2, 112-3 and three return leaf springs 120-1, 120-2, 120-3 are provided in correspondence with the three solenoids. The return leaf springs 120-1, 120-2, 120-3, made of phosphor bronze or the like, constitute a return leaf spring assembly 120 and are formed integrally to facilitate their positioning with respect to the three solenoids.

Latch portions 120*a*, 120*b* are respectively provided at opposite ends of the return leaf spring assembly 120 and are adapted to engage with engaging slits 111*c*, 111*d* respectively provided at opposite ends of the yoke 111, thereby allowing the return leaf spring assembly 120 to be held integrally by the yoke 111.

Accordingly, this return leaf spring assembly 120 of an integral type can be fabricated easily by stamping a phosphor bronze sheet o the like.

In addition, a bent portion of each return leaf spring in accordance with this embodiment is provided with a C-shaped configuration having an opening in a central portion thereof, thereby making it possible to provide a stable returning force with weak resiliency of the spring. Incidentally, the return leaf spring shown in FIG. 3 has a configuration in which the bent portion thereof is bifurcated.

Meanwhile, the armatures 112-1, 112-2, 112-3 constitute a set of armatures 112 and are separately formed, each provided, on the opposite sides of its tail, with slits 112*b*, 112*c* which engage with a slit 111*e*-1, 111*e*-2, or 111*e*-3 provided in the yoke 111, thereby positioning the return leaf spring assembly 120 while pressing the same.

The armatures 112-1, 112-2, 112-3 are securely held by the yoke 11 as the return springs 15 are respectively stretched between projections 121 of the armatures 112-1, 112-2, 112-3 and the baseplate.

Figure 5:
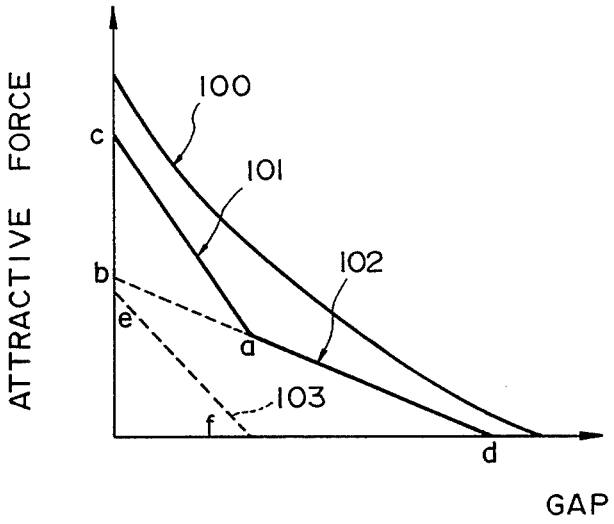
FIG. 5 is an explanatory diagram illustrating the characteristics of the return leaf spring in accordance with the present invention.

FIG. 5 is a characteristic diagram illustrating the attractive force 100 of the solenoid, the synthetic returning force 101, and the armature returning force 102 derived from the returning force of the armature returning spring in a case where the electromagnetic actuator in accordance with the present invention is used, in correspondence with changes in the gap between the core 10*c* and the armature 12, 112.

In the drawing, the ordinates represent the attractive force or the returning force of the armature, while the abscissas represent the gap between the core 10*c* and the armature 12, 112.

The characteristic 103 in FIG. 5 illustrates the returning force of the return leaf spring 20, 120 alone (line e–f in the drawing). The characteristic 100 in the drawing illustrates the attractive force of the solenoid at the time when the coil 10*a* is being energized, in correspondence with changes in the gap, and its characteristic curve forms a curve of the second order which is substantially inversely proportional to the square of the gap.

In addition, the characteristic 102 illustrates the returning force of the armature derived from the returning force of the conventional armature returning spring 15, and the gradient of its characteristic curve (line b-a-d in the drawing) is less sharp than that of the aforementioned characteristic 103. The characteristic 101 illustrates the characteristic (line c-a-d in the drawing) of a synthetic returning force in which the returning force 102 of the armature returning spring is synthesized with the returning force 103 of the return leaf spring alone in accordance with the present invention. With respect to this characteristic 101, a large armature returning force is obtained when the gap is relatively small, i.e., in the state in which the return leaf spring 20, 120 is deflected, in which case the gradient of its characteristic curve (line c-a in the drawing) is sharp.

This fact shows that the synthetic returning force in which the returning force (line b-a) of the return spring is synthesized with the returning force (line e-f) of the return leaf spring approximates the attraction characteristic of the armature attributable to the electromagnet. This shows that the instant release of the armature during a shut-off of the current is possible (line c-a).

Consequently, the return leaf spring 20, 120 in accordance with the present invention acts in such a manner as to aid the returning operation of the armature 12, 112 by means of the return spring 15, 115 at the position in which the armature is released from the core and in its vicinity, thereby allowing the armature to be released from the core instantly in conjunction with a shut-off of the current.

In other words, when the current being supplied to the solenoid is shut off, the magnetic attractive force is cut off, and the armature 12, 112 thereby returns. The returning force of the armature 12, 112 at that time is constituted by the synthetic returning force 101 indicated by the line c-a-d, in which the returning force 103 of the return leaf spring alone is synthesized with the returning force 102 of the armature returning spring.

As described above, the electromagnetic actuator in accordance with the present invention comprises a nonmagnetic return leaf spring interposed between the core and the armature and provided with a portion bent in the direction of its thickness, and a powerful releasing characteristic is obtained by virtue of the resiliency of this bent portion.

In other words, the electromagnetic actuator in accordance with the present invention permits instant release of the armature thanks to the adoption of the return leaf spring during a shut-off of a current, in addition to preventing a delay in the release of the armature caused by residual magnetism in the same way as in the prior art in which the armature is prevented from being contacted directly to the core by the use of a nonmagnetic spacer which is merely secured to the core.

As a result, in a case where the electromagnetic actuator in accordance with the present invention is applied to the above-describe impact printer, advantages can be obtained in that electromagnetic actuator is capable of positively preventing faulty printing in the impacting operation of a hammer, has a simple structure without any increase in the number of components used, and consumes less power and produces less heat than a conventional one.

What is claimed is:

1. An electromagnetic actuator comprising:

a base plate;

a solenoid for producing a magnetic attractive force upon supply of an electric current thereto;

a yoke disposed on said base plate with said solenoid for introducing a magnetic flux produced by said solenoid;

an armature having one end rotatably supported by said yoke and the other end attracted toward an end surface of a core of said solenoid;

a return spring stretched in a state of tension between said base plate and the end of said armature for urging said armature to be released from said solenoid; and a return leaf spring interposed between said core and said armature and formed of a non-magnetic material, said return leaf spring having a V-shaped configuration with the bent portion of the convex side being in contact with the end surface of said solenoid;

whereby said armature is deflected to store supplemental releasing force for said armature when said solenoid attracts said armature, and powerful releasability is provided by the restoring force of said return leaf spring.

2. An electromagnetic actuator according to claim 1, wherein tails of said armature and said return leaf spring are respectively rotatably supported at slits provided in said yoke.

3. An electromagnetic actuator according to claim 2, wherein said armature and said return leaf spring are supported at a common slit provided in said yoke.

4. An electromagnetic actuator according to claim 1, wherein a plurality of said return leaf springs are formed integrally as an assembly in correspondence with a plurality of said solenoids.

5. An electromagnetic actuator according to claim 4, wherein said assembly of return leaf springs is engaged with said yoke at opposite ends thereof.

6. An electromagnetic actuator according to claim 5, wherein said assembly of return leaf springs is positioned and held by a plurality of said armatures each having a tail rotatably supported by said yoke, said armature being securely held by a return spring stretched between said armature and a baseplate of said yoke.

7. An electromagnetic actuator according to claim 1, wherein said armature does not abut said leaf spring when said armature is on standby for printing, and said armature deflects said leaf spring by being brought into contact therewith only in a final stage when said armature is attracted toward said core by the attractive force of said solenoid.

* * * * *